US007948388B2

(12) United States Patent
McGinty et al.

(10) Patent No.: US 7,948,388 B2
(45) Date of Patent: May 24, 2011

(54) WATER DETECTION UNIT AND SYSTEM

(76) Inventors: Joseph Ralph McGinty, Madison, AL (US); Derek Phelps Gardner, Huntsville, AL (US)

( * ) Notice: Subject to any disclaimer, the term of this patent is extended or adjusted under 35 U.S.C. 154(b) by 98 days.

(21) Appl. No.: 11/458,840

(22) Filed: Jul. 20, 2006

(65) Prior Publication Data

US 2007/0024458 A1 Feb. 1, 2007

Related U.S. Application Data

(60) Provisional application No. 60/700,761, filed on Jul. 20, 2005.

(51) Int. Cl.
*G08B 21/00* (2006.01)
*F17D 5/02* (2006.01)

(52) U.S. Cl. ..... 340/605; 340/604; 137/15.11

(58) Field of Classification Search ..... 340/605, 340/604; 137/15.11
See application file for complete search history.

(56) References Cited

U.S. PATENT DOCUMENTS 3,856,610 A * 12/1974 Bruneel ..... 428/76
5,008,652 A * 4/1991 Woloszyk ..... 340/605
5,192,932 A * 3/1993 Schwab, Jr. ..... 340/604
5,299,591 A * 4/1994 Duncan ..... 137/15.11
5,748,092 A * 5/1998 Arsenault et al. ..... 340/604
6,025,788 A * 2/2000 Diduck ..... 340/870.16
6,639,517 B1 * 10/2003 Chapman et al. ..... 340/605
6,640,502 B2 * 11/2003 Mueller ..... 52/22
2003/0011482 A1 * 1/2003 Harms et al. ..... 340/605
2004/0046671 A1 * 3/2004 Ninberg ..... 340/605

* cited by examiner

*Primary Examiner* — Daniel Wu
*Assistant Examiner* — John F Mortell
(74) *Attorney, Agent, or Firm* — Gardner Groff Greenwald & Villanueva PC

(57) ABSTRACT

A leak detector apparatus and system for use with a drop ceiling having a grid-work of ceiling tiles. The leak detector apparatus includes an electrically non-conducting tile body that is shaped and dimensioned to rest on top of a ceiling tile. The tile body comprises multiple layers of non-conducting closed cell-foam and has a plurality of water collector cups formed or positioned therein. Spaced-apart sensor wires are provided and form an electrical grid that extends between the multiple layers of the tile body and the sensor wires generally extend through the water collector cups. The sensor wires are operative to sense the presence of water in the cups. An electronics module is provided at each tile body and is associated with the sensor wires and electrically coupled to the sensor wires for triggering an alert in response to the presence of water in one or more of the cups. A master controller is in communication with the local processors for monitoring the function and operation of each local processor. Thus, each leak detector tile has its own electronics module associated with it, thereby providing excellent location precision when installed in the room.

24 Claims, 19 Drawing Sheets

Water Sensing Cell Assembly

Figure 1: Water Sensing Cell Assembly

Figure 2: Middle Layer Detail

Figure 3: Water Sensing Cell Exploded View

Figure 4: Water Sensing Cell Assembly

Figure 5: Low Sensitivity Section View

Figure 6: High Sensitivity Section View

Figure 7: Sensor Array for Standard 2 X 2 Foot Tile

Figure 8: Sensor Array Wiring Detail

Figure 9: Sensor Array for Long Rolls

Figure 10: Mat Electronics Block Diagram

Figure 11: System Electronics Block Diagram

Figure 12: Master Controller Software flowchart

Figure 13: Mat Sensor System 90 Software flowchart

WATER DETECTION UNIT AND SYSTEM

CROSS-REFERENCE TO RELATED APPLICATION

The benefit of the filing date of U.S. provisional patent application Ser. No. 60/700,761, filed Jul. 20, 2005, entitled WATER DETECTION CELL AND SYSTEM, is hereby claimed, and the specification thereof is incorporated herein by this reference.

TECHNICAL FIELD

The present invention relates generally to a water sensing system and in particular relates to a water detection system for use with drop ceilings.

BACKGROUND OF THE INVENTION

Every year, considerable damage is done to homes and business establishments by leaking water from roof leaks, plumbing fixtures, pipes, water heaters, air conditioners, and other appliances. These leaks often occur for a long period of time before any evidence or damage is noticed, often with catastrophic results, such as floors falling in or ceiling material dropping into the room below. This damage often results in insurance claims and settlements that cost businesses, consumers and insurance companies untold millions of dollars per year. Although there are some leak detection systems in the market, most are expensive, complicated, and/or difficult for the user to install.

In recent years the so-called dropped ceiling has become popular. In this arrangement, a grid-work of thin metal beams is suspended from the ceiling or other structure. Ceiling tiles are then placed in the (rectangular or square) openings defined by the grid-work. This ceiling is popular in homes and offices alike.

In many instances, the drop ceiling is positioned above a room containing expensive or critical equipment or inventory. A ready example of this is the ubiquity of computers and computer servers in modern offices, typically below a drop ceiling. When there would be a water leak above the drop ceiling, the drop ceiling tends to obscure the leak until it becomes a substantial problem. It often occurs that the leak develops at night, on weekends, or other times when workers might not notice immediately. These leaks can be catastrophic to the operation of a business. For example, consider a web-based business that relies heavily on its computers and servers. A flood in a room housing such equipment poses a serious risk to the enterprise.

One approach to this problem has been a leak detection system provided by Dorlen Products Inc. of Milwaukee, Wis., under the trademark CEILING GUARD. This product comprises a series of sensing panels affixed to a customer's ceiling. Each panel is in the form of a trough with liquid sensors positioned in the bottom of the trough. The troughs are electrically connected to one another in order to be able to monitor a large zone. Each zone, which can be up to 320 ft.$^2$, terminates in a detector module that provides audible alarms for water sensed in the zone and signals a central monitoring controller or panel that there has been a problem. These sensing panels are provided with end ribs or dams that prevent liquid from leaking out of the sensing panels. However, retaining all of the moisture in these troughs can lead to a catastrophic failure of the ceiling inasmuch as a typical drop ceiling is not intended to support the weight of a substantial amount of water. Moreover, these sensing panels can be difficult for an end user to install. Furthermore, this zone approach does not inform the user about which panel has suffered a liquid leak, but instead only informs the user of which zone is suffering from a liquid leak.

Accordingly, it can be seen that a need yet remains in the art for a leak detection system and leak detector tile that is easily installed, is relatively inexpensive, provides precise leak location sensing, and is reliable in operation. It is to the provision of such a leak detection system and leak detector tiles that the present invention is primarily directed.

SUMMARY OF THE INVENTION

Briefly described, in a first preferred form the present invention comprises a leak detector apparatus for use with a drop ceiling having a grid-work of ceiling tiles. Preferably, the leak detector apparatus includes an electrically non-conducting tile body that is shaped and dimensioned to rest on top of a ceiling tile. The tile body comprises multiple layers and has a plurality of water collector cups formed or positioned therein. Spaced-apart sensor wires are provided and form an electrical grid that extends between the multiple layers of the tile body and the sensor wires generally extend through the water collector cups. The sensor wires are operative to sense the presence of water in the cups. An electronics module is associated with the sensor wires and is electrically coupled to the sensor wires for triggering an alert in response to the presence of water in one or more of the cups. Thus, each leak detector apparatus or leak detector tile has its own electronics module associated with it, thereby providing excellent location precision when installed in the room. In this way, leaks can be pinpointed, as opposed to simply being indicated as being somewhere in a large zone.

Preferably, the tile body is formed in such a way as to have shallow funnels for collecting water and funneling the water into the collector cups. Advantageously, the tile body is formed from a flexible, closed cell, non-conducting foam, allowing it to be configured or conformed to varying shapes as required. This can be very handy when working around obstructions and corners, etc.

Preferably, the spaced-apart sensor wires are spaced from one another horizontally and vertically. Optionally, these spaced-apart sensor wires can be spaced apart only horizontally or only vertically. Preferably, the sensor wires can be positioned between adjacent layers of the foam tile body. Advantageously, the foam acts to insulate the wires such that otherwise bare wire can be used in the leak detector tile.

Optionally, the tile body has dimples formed in a lowermost layer thereof, which tends to deepen the water collector cups. This feature can be used to create or combined with the form of the lowermost layer to support the tile body substantially above the ceiling tile to minimize the growth of mold, algae, mildew, and/or fungus on the underside of the tile body.

Optionally, the spaced apart sensor wires form a grid in the tile body in such manner as to allow the tile body to be trimmed to a final dimension, as in being trimmed to a final length or final width and/or both. This allows for greater flexibility in installing the leak detector in many applications.

In another form of the invention, the present invention comprises a leak detection system for use with a drop ceiling of the type having a plurality of ceiling tiles and grid frames supporting the ceiling tiles. The leak detection system includes a plurality of lightweight leak detection tiles. The leak detection tiles are adapted to be placed on top of the ceiling tiles of the drop ceiling. Each of the leak detection tiles includes one or more sensors for detecting the presence of liquid at one or more locations on the ceiling tile. Local processors (electronic modules) are provided and are electrically coupled to the sensors, with the local processors being provided one per leak detection tile. A master controller is provided in communication with the local processors for monitoring the function in operation of each local processor.

In this way, master controller can determine which, if any, of the leak detection tiles has detected a leak. This also allows the local processors to be linked to one another in a simplified, daisy-chain arrangement.

Optionally, the leak detection system can include deflector roofs that are adapted to be positioned atop the grid frame for deflecting liquid that might otherwise impinge on the grid frame and for deflecting that liquid onto an adjacent leak detection tile. Optionally, the deflector roofs can be made from flexible foam to allow them to be cut to length and conformed to fit closely against the grid and/or wires supporting the grid.

Other features and advantages of the invention will become evident from reading the following description of the invention in conjunction with the accompanying drawings.

DETAILED DESCRIPTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
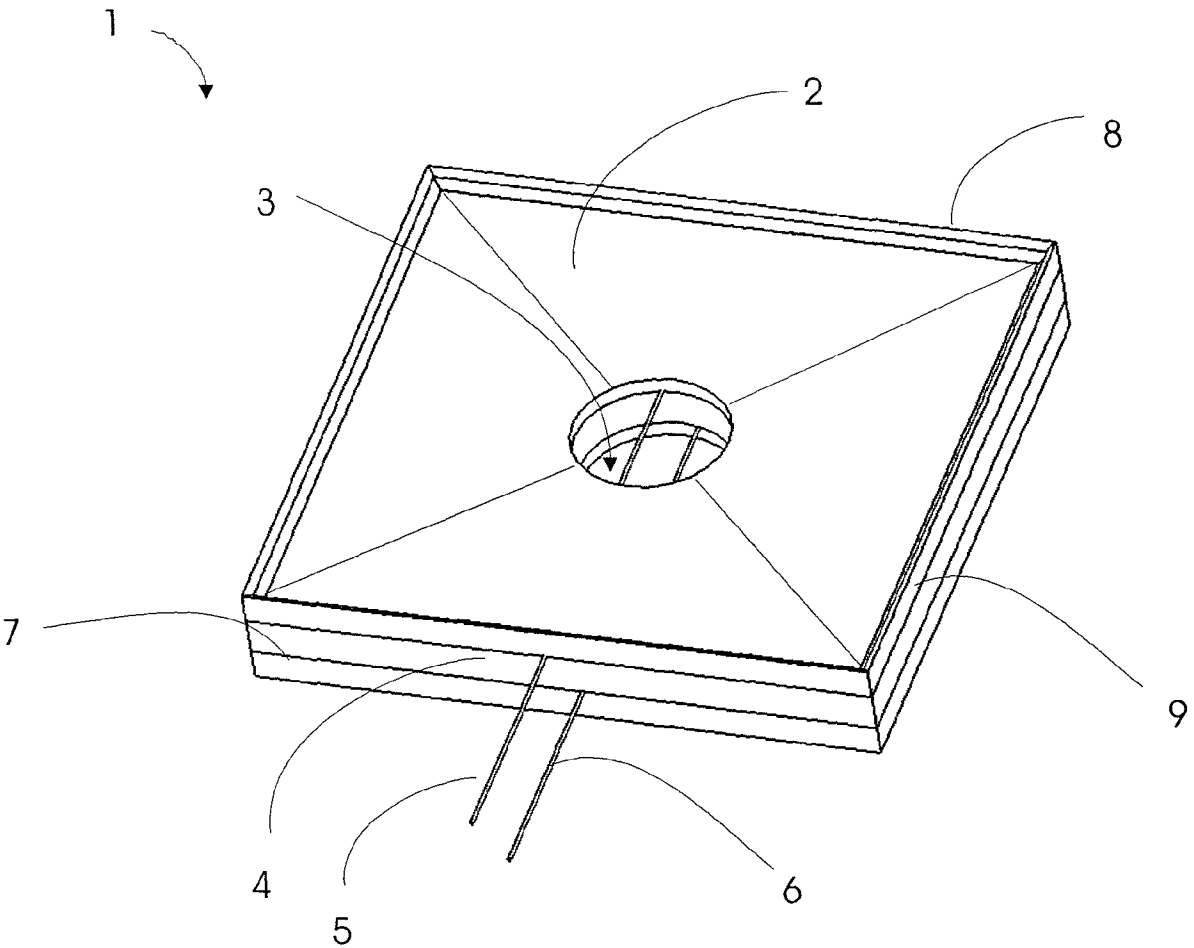
FIG. 1 is a perspective view of a leak detector unit having a plurality of layers according to a first example embodiment of the present invention.

With reference now to the drawing figures, in which like numerals represent like elements or steps throughout the several views, FIG. 1 depicts a leak detector unit 1 according to a first example embodiment of the present invention. The leak detector unit 1 is preferably constructed of three or more layers of foam, rubber, and/or plastic, however, other appropriate non-conducting, non-absorbing materials can be used. In example embodiments, the leak detector unit has a body comprised of a top layer 9, a middle layer 4, and a bottom layer 7. Preferably, the layers have appropriate adhesive coatings on each to allow them to be permanently bonded together. In FIG. 1 the leak detector unit 1 is shown in a square configuration with sides approximately 4 inches long, but it should be noted that the leak detector unit can be constructed in virtually any size or shape.

In example embodiments, the leak detector unit 1 includes a waterproof, or otherwise water resistant, water diversion surface 2 and a water collection cup 3. The water diversion surface 2 funnels any water that contacts the surface towards a water collection cup 3. The water collection cup 3 is preferably positioned in the center of the leak detector unit 1 in order to receive any such water. The leak detector unit 1 also includes a water dam or lip 8 that lines the circumference of the unit's top layer 9. The water dam 8 helps direct water that may reach the diversion surface 2 towards the collection cup 3 rather than escape. The water collection cup 3 is formed by creating an opening in some, but not all, of the layers of the leak detector unit's 1 body. The opening is depicted in the shape or a circle; however, the opening can be any desired shape.

The leak detector unit 1 also includes a water sensing mechanism as seen in FIG. 1. In example embodiments, the water sensing mechanism is formed by two wires: a top sensor wire 5 and a bottom sensor wire 6. The wires are placed within the water collection cup 3. It is preferable, but not required, that each wire is non-insulated and coated with conduction materials that resist corrosion and oxidation for the life of the cell. Water (not shown) that bridges top sensor wire 5 and bottom sensor wire 6 creates an electrical contact, wherein the electrical resistance between the top sensor wire 5 and the bottom sensor wire 6 is lowered significantly. By lowering the electrical resistance between the two wires a sensor attached to the wires can detect the presence of water in the unit 1 (discussed further below).

Figure 2:
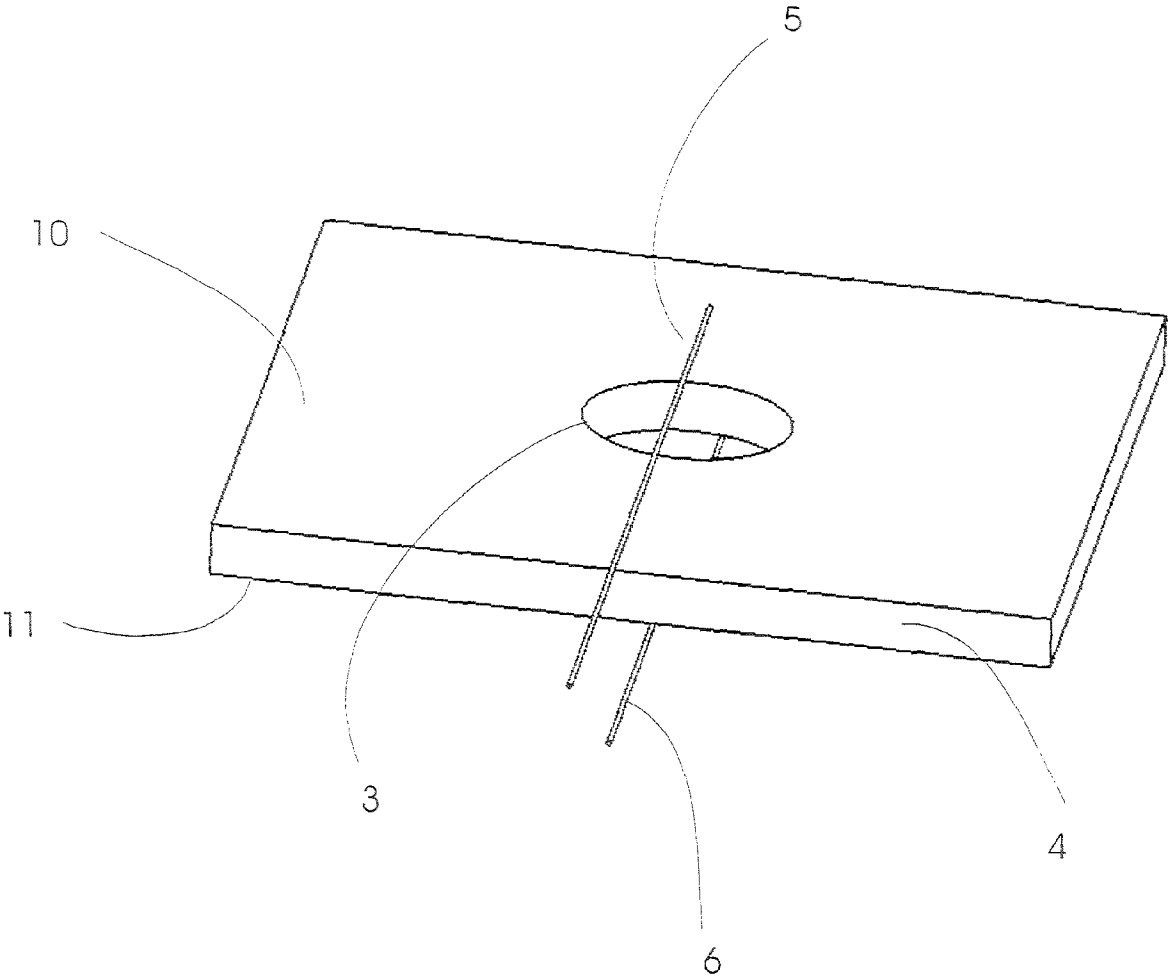
FIG. 2 is a perspective view of an internal layer of the leak detector unit shown in FIG. 1.

Referring now to example embodiments depicted in FIG. 2, top sensor wire 5 can be placed on the top surface of middle layer 4 so that it rests between the middle layer 4 and the top layer 9. Adhesive 10 can be used to help secure the wire 5 to middle layer 4. Though shown in a single unit configuration in FIG. 2 the wire can continue to other water collection cups 3 to form a leak detector apparatus, which will be discussed in greater detail below. The bottom sensor wire 6 can be similarly placed on the bottom of the middle layer 4, and can be further secured in place with an adhesive 11. Thus, in example embodiments, the top sensor wire 5 and the bottom sensor wire 6 can be physically separated from each other by the thickness of middle layer 4. By configuring the leak detector unit 1 in this fashion, the unit can be adjusted for water sensitivity during the manufacturing process.

Figure 3:
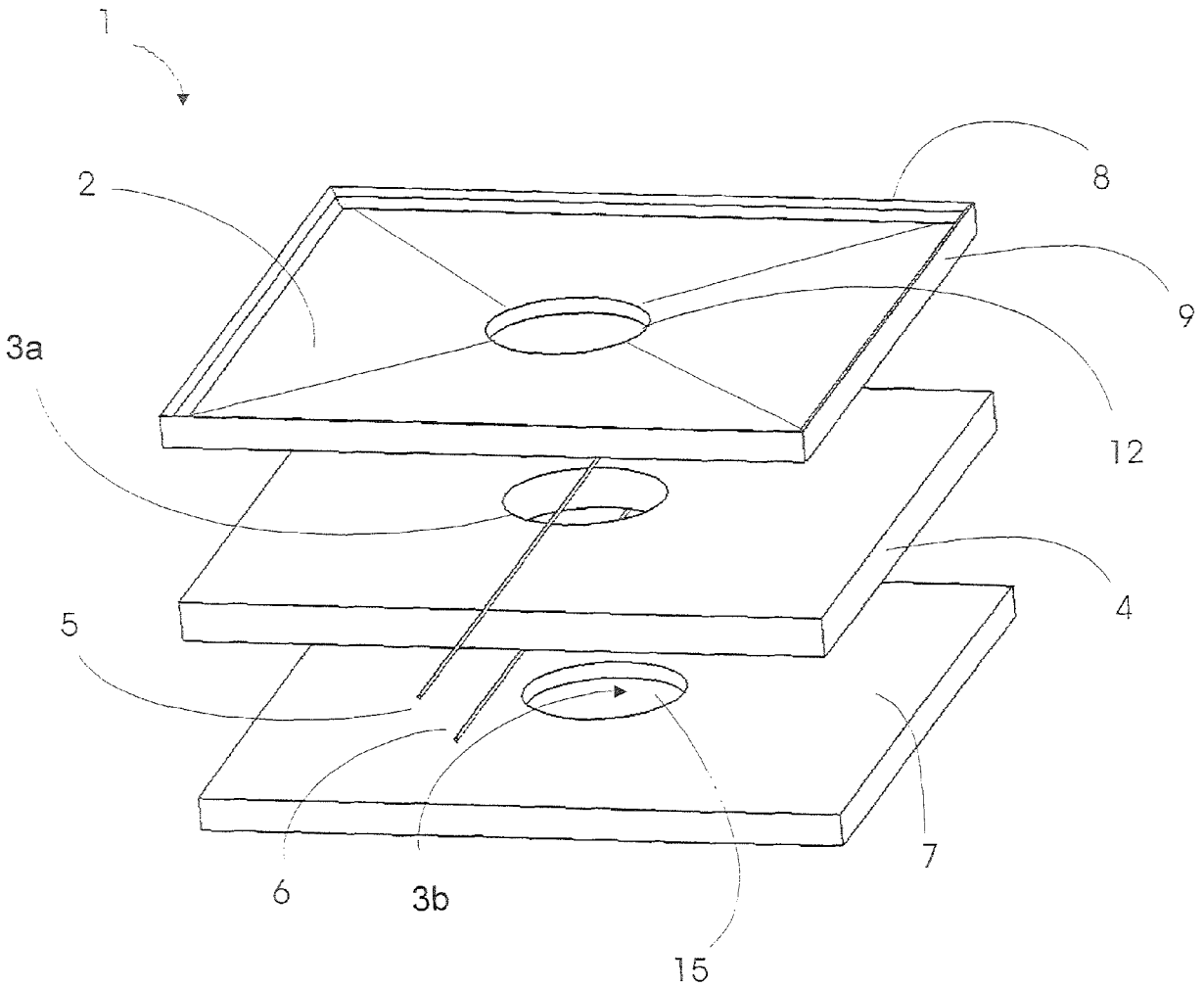
FIG. 3 is an exploded perspective view of the leak detector unit shown in FIG. 1.
Figure 4:
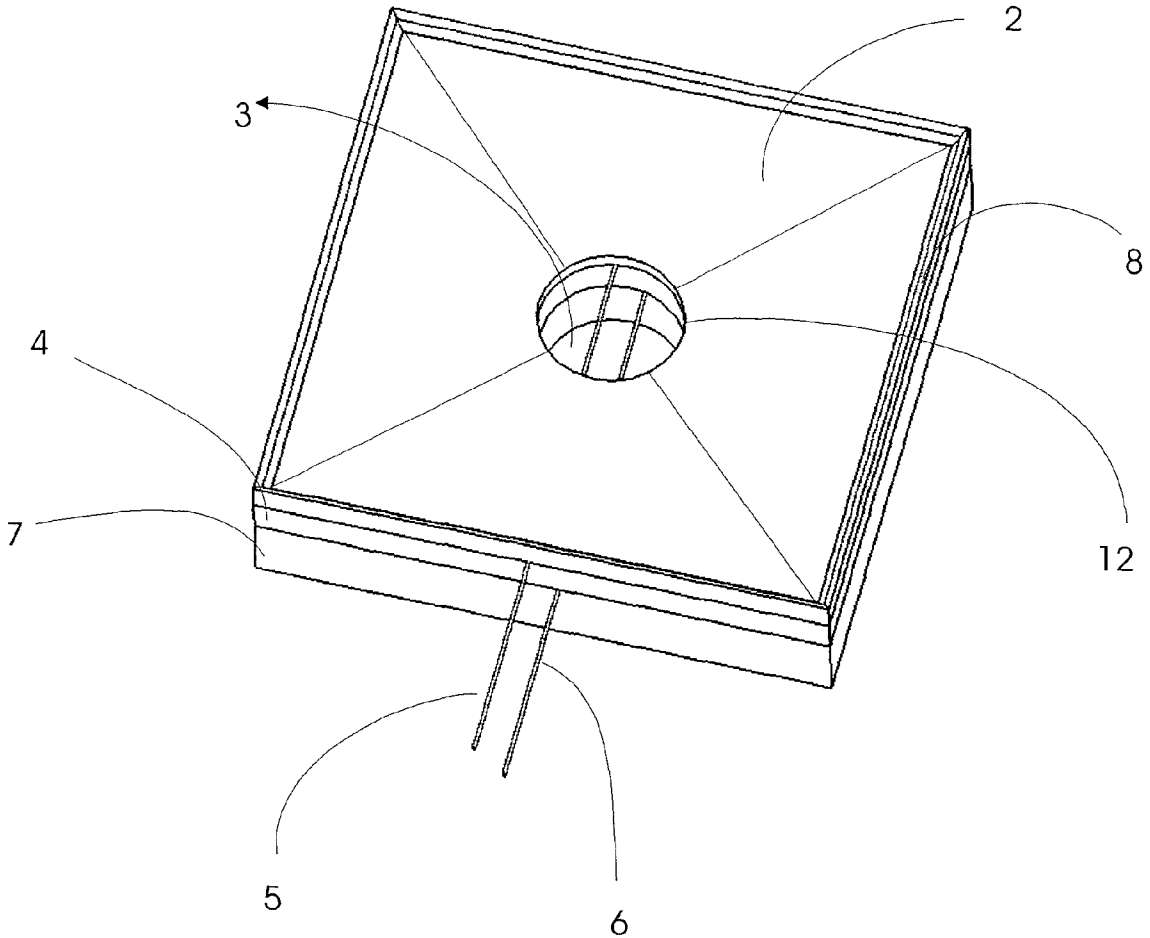
FIG. 4 is a perspective view of the leak detector unit shown in FIG. 1.

FIG. 3 shows the leak detector unit 1 before assembly. As previously discussed, the middle layer 4, along with top sensor wire 5 and bottom sensor wire 6, is placed between the top layer 9 and bottom layer 7. The water collection cup 3 is created by a collection cutout 12, along the top layer 9, and by water collection cup middle 3*a* and water collection cup bottom 3*b*. The layers are then pressed together, and secured by the top adhesive surface 10 and the bottom adhesive surface 11. Adhesive layers can also be added to the bottom of the top layer 9 and the top of the bottom layer 7 to strengthen the bond if necessary. FIG. 4 shows the completed assembly after being pressed together and the bonding of the appropriate surfaces.

Figure 5:
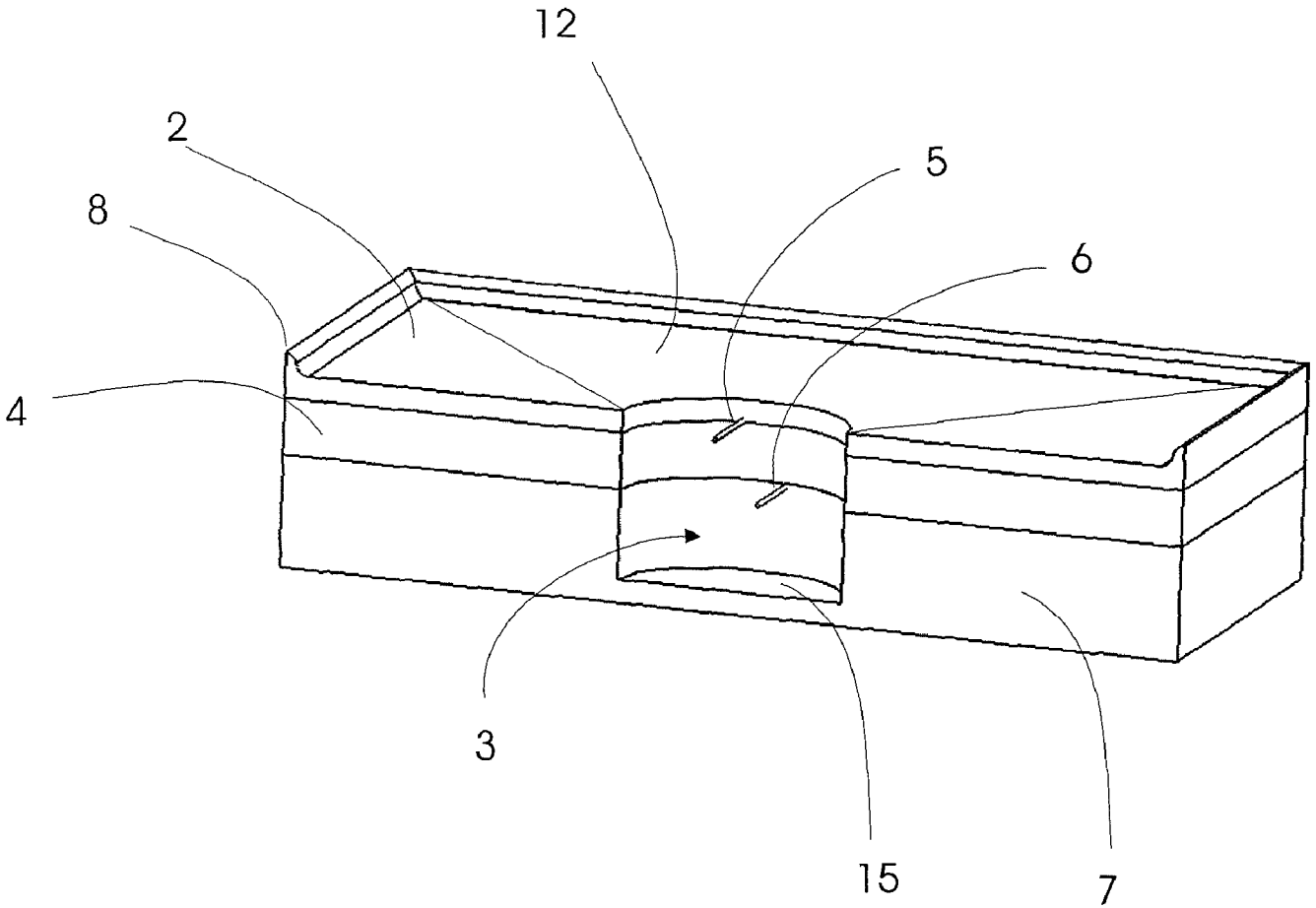
FIG. 5 is a cutaway perspective view of the leak detector unit shown in FIG. 1 depicted with a deep cup.

The water collection cup 3 and sensor wires 5, 6 form a water sensor system. As it is best seen in FIG. 5, the water collection cup 3 is formed by the bonding of the layers together as previously discussed. The adhesives applied to the layers' surfaces bond the layers, and form a seal to prevent collected water from escaping the water collection cup 3. The bottom of the water collection cup 3 is formed by an indention in the bottom layer 7. The depth of the water collection cup 3 can be formed by the depth of the indention 15 and the thickness of middle layer 4. It is preferred that the bottom sensor wire 6 does not remain in contact with any dampness in the bottom of the water collection cup 3 because of the indention 15, thereby minimizing any corrosive effects of long term moisture. Thus the sensitivity of the sensor can be adjustable in the manufacturing process by adjusting the thickness of the middle layer 4, the depth of the indention 15 in the bottom layer 7, and the area of the opening forming the water collection cup 3 (in this case the diameter).

Example configurations of the water collection cup 3 and the sensor wires 5,6 are designed to minimize false alarms from condensation or other sources of minute amounts of water that do not pose a threat to equipment or safety. This is accomplished by three features:

1. The depth of the water collection cup 3 requires a specific amount of water to be present before both sensor wires 5,6 are immersed in the water. The amount of water required is proportional to the diameter and depth of the water collection cup 3.
2. The sensor wires 5,6 are physically separated in the vertical and horizontal planes. Water droplets cannot lodge between the sensor wires because of the small surface areas and gravity.
3. The surface area of the sensor wires 5,6 that comes in contact with the foam is very small. Thus, condensation that tends to coat all surfaces produces an extremely small conduction path.

Figure 6:
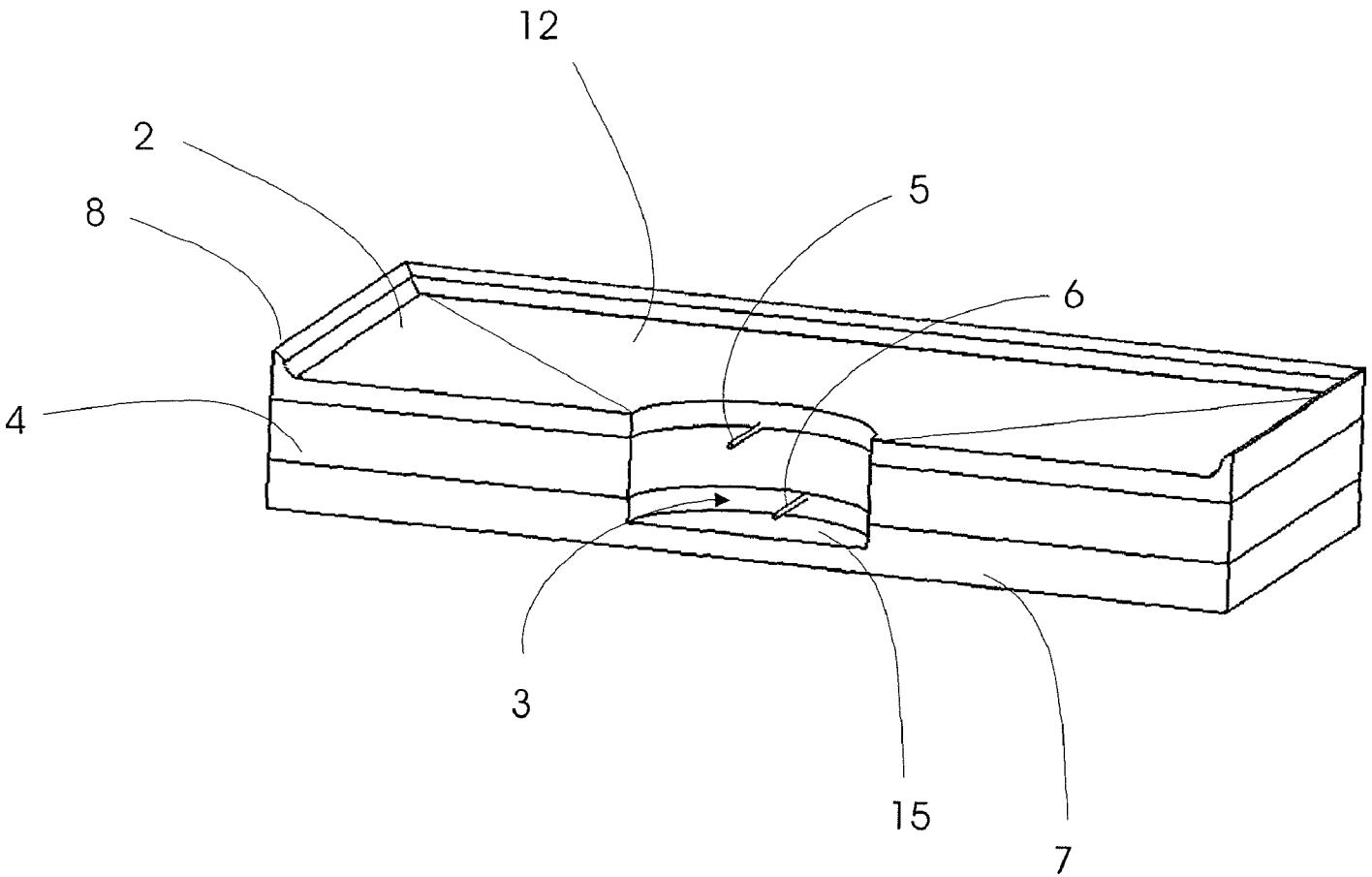
FIG. 6 is a cutaway perspective view of the leak detector unit shown in FIG. 1 depicted with a shallow cup.

FIG. 6 depicts a leak detector unit 1 configured with a thinner bottom layer 7 than shown in the previous examples. In this regard, a much smaller amount of water is needed before the water bridges the sensor wires, resulting in a more sensitive leak detector unit. Various other means of adjusting the leak detector unit 1 are capable of being used including, adjusting the height of the sensor wires within the cup 3, adjusting the thickness of the middle layer 4, etc.

Figure 7:
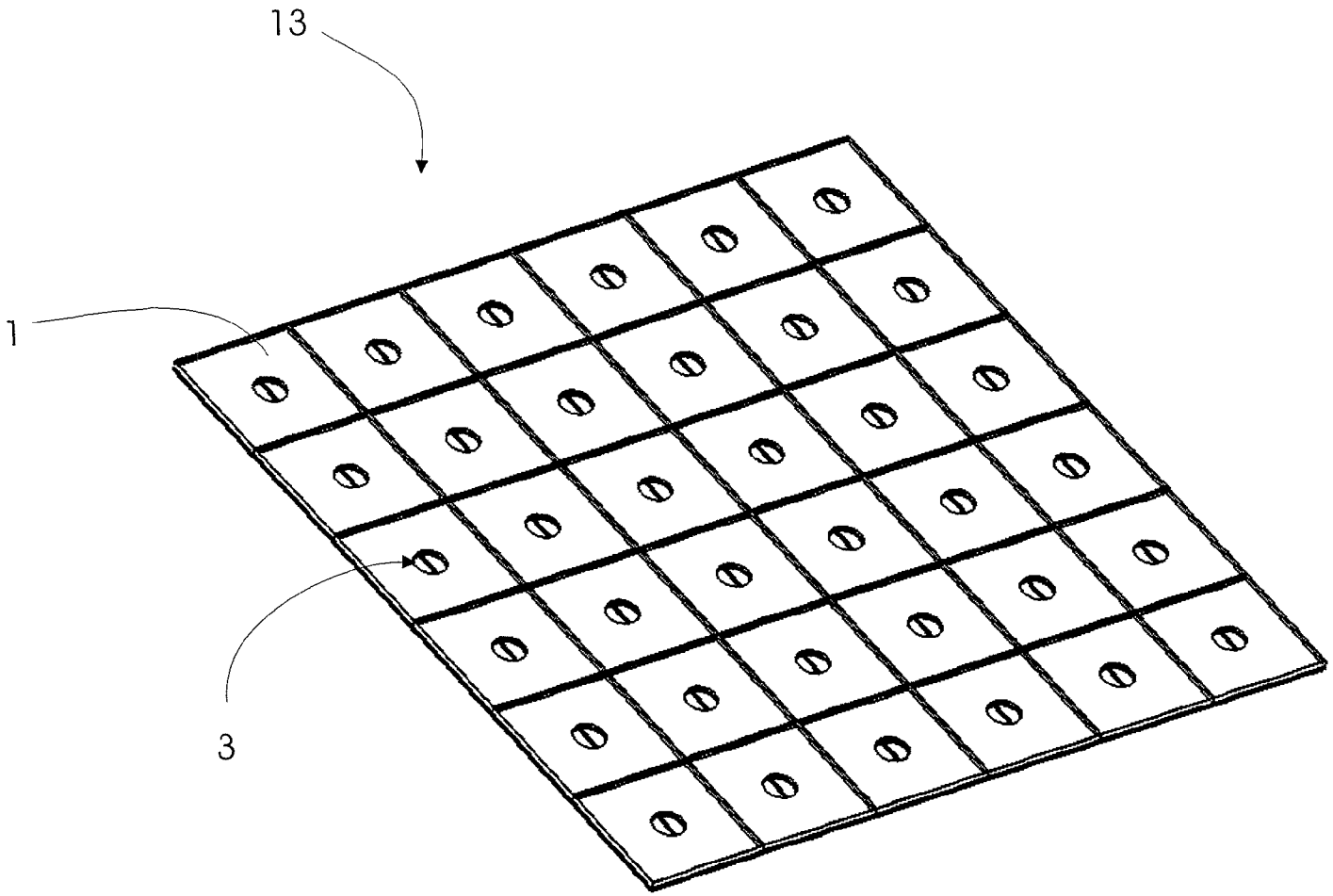
FIG. 7 is a perspective view of a plurality of leak units shown in FIG. 1 arranged into a leak detector apparatus.

While the aforementioned description of the leak detector unit 1 is only one individual unit, in actual practice, the cells can be combined into virtually any shape and/or configuration to create a leak detector apparatus 13. One such configuration, for example, is shown in FIG. 7. This example configuration uses multiple units to produce a large, two feet by two feet ceiling tile mat. In other example embodiments, the tile mat can be other standard sizes including 4 feet by 2 feet. The ceiling tile mat depicted in FIG. 7 can cover about 4 square feet and can potentially sense the presence of water anywhere within that area.

Figure 8:
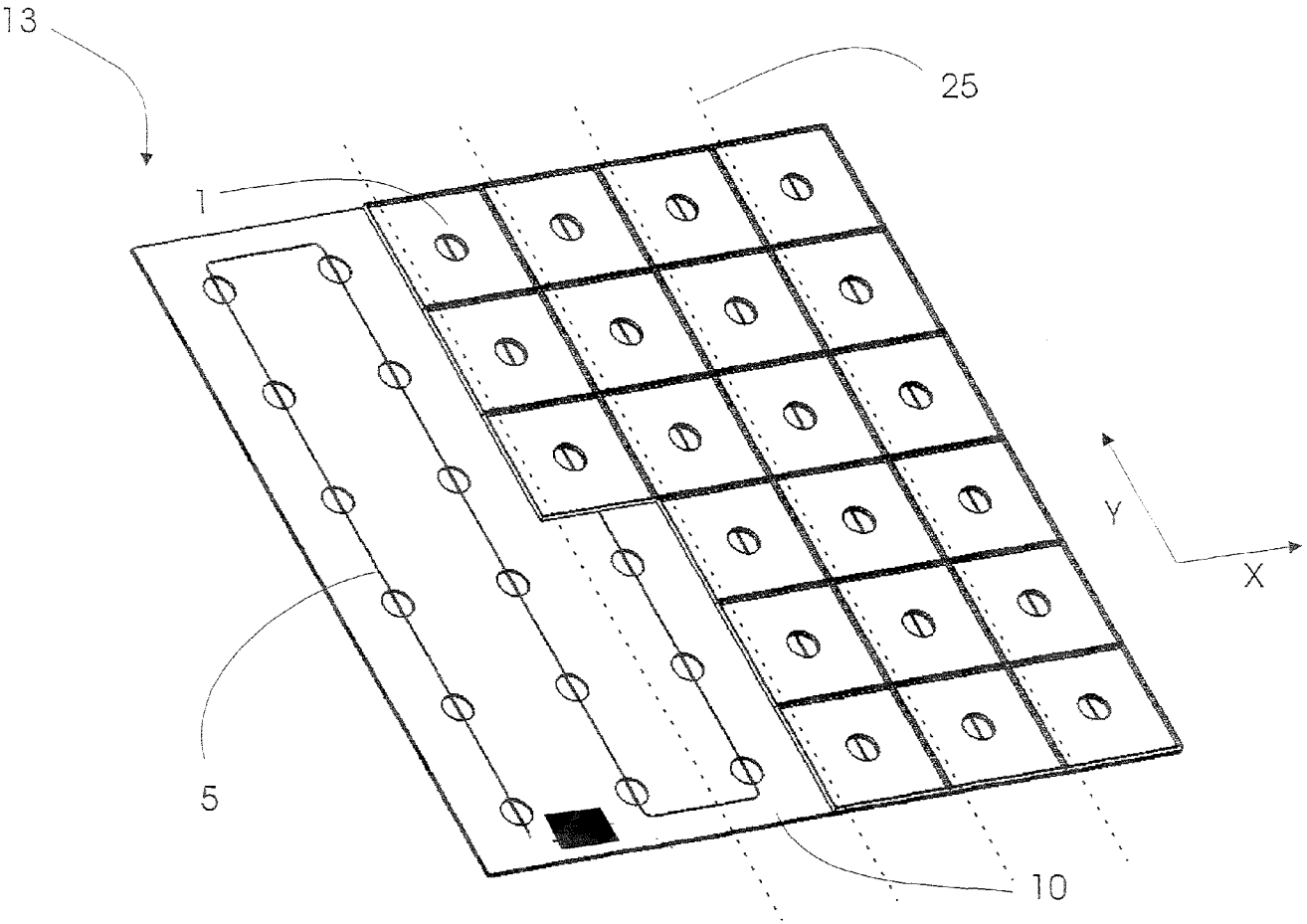
FIG. 8 is a cutaway view of a leak detector apparatus as shown in FIG. 7.

In example embodiments, the sensing wires 5,6 are continuous, as shown in FIG. 8, and can be placed within all of the water collection cups 3 during the manufacturing process, making the leak detector apparatus very easy and inexpensive to produce. Each layer of the leak detector apparatus can be die-cut or molded to the required configuration on a full sized basis. For example, each layer of the apparatus 13 can be formed in one full size sheet, instead of unit-sized pieces. If the apparatus 13 needs to be trimmed to fit a desired installation, the apparatus can be cut along lines 25 as seen in FIG. 8. Of course, there are numerous configurations for wiring the apparatus 13, and therefore numerous ways that the apparatus can be trimmed to fit a particular installation. It should also be noted, that the apparatus 13 is flexible and can be folded if desired by a user.

Figure 9:
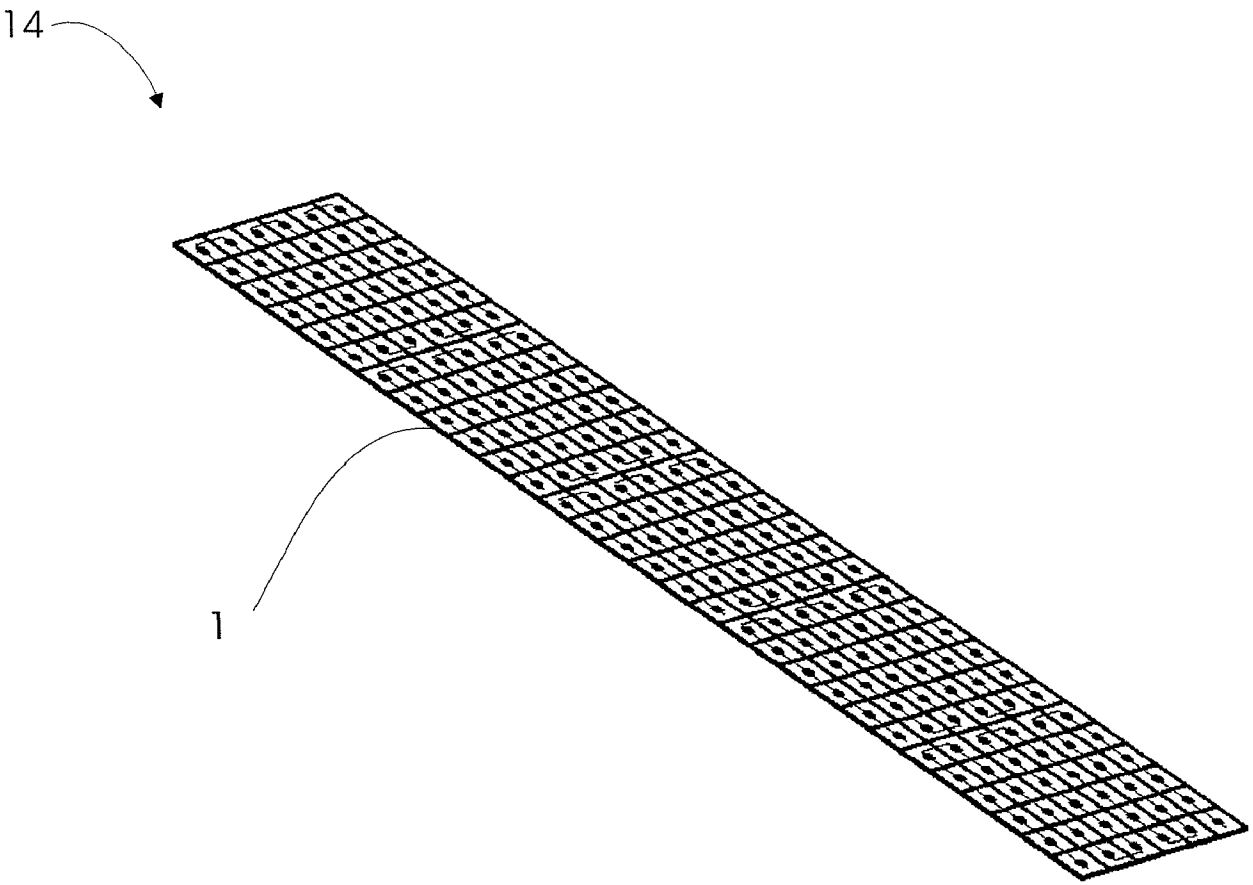
FIG. 9 is a perspective view of a plurality of leak detector units shown in FIG. 1 arranged into a roll of leak detector apparatuses.

In other example embodiments, the leak detector units 1 can be configured in a long roll mat 14 as seen in FIG. 9. In still other embodiments, the units 1 can be constructed in even longer rolls, such as carpet sized rolls, for water sensing abilities over large areas.

Figure 10:
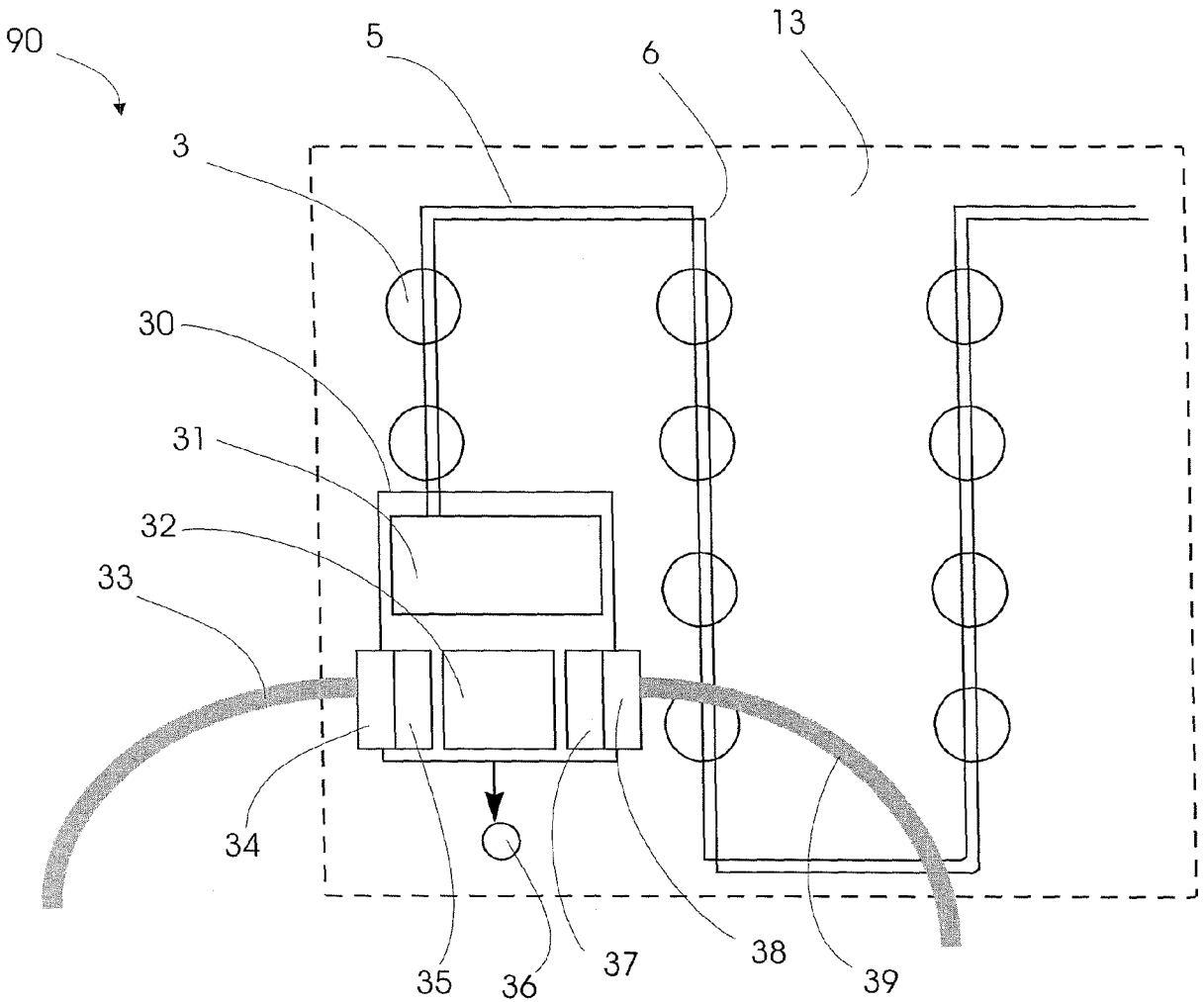
FIG. 10 is a plan view of a wiring diagram for the leak detector apparatus shown in FIG. 7.

FIG. 10 depicts an example leak detector system 90 to be used in conjunction with the leak detector apparatus 13. In preferred embodiments, a microprocessor 32 is mounted onto a printed circuit board 30. The microprocessor 32 interfaces with the top sensor wire 5 and the bottom sensor wire 6 via electronics 31 to determine if water has bridged the top sensor wire and the bottom sensor wire. If the microprocessor 32 determines that water is present, the microprocessor will activate the local indicator 36, which may be a light, audible sound, etc., to alert the user of the presence of water. In other preferred embodiments, the microprocessor 32 will notify a user of the location water was detected. The microprocessor 32 also interfaces with a master controller 100 (FIG. 11) via general circuitry, connectors 35, 36 and cable 33. In example embodiments, the microprocessor 32 responds to the master controller 100 as a slave unit using a polling scheme. In other words, the status of the microprocessor 32 is transferred to the master controller only when the master controller polls the microprocessor at a unique specific address. Connectors 37 and 38 forward the polling information, via cable 39, to any sequential leak detector systems 90 to allow the master controller 100 to poll all systems present.

Figure 11:
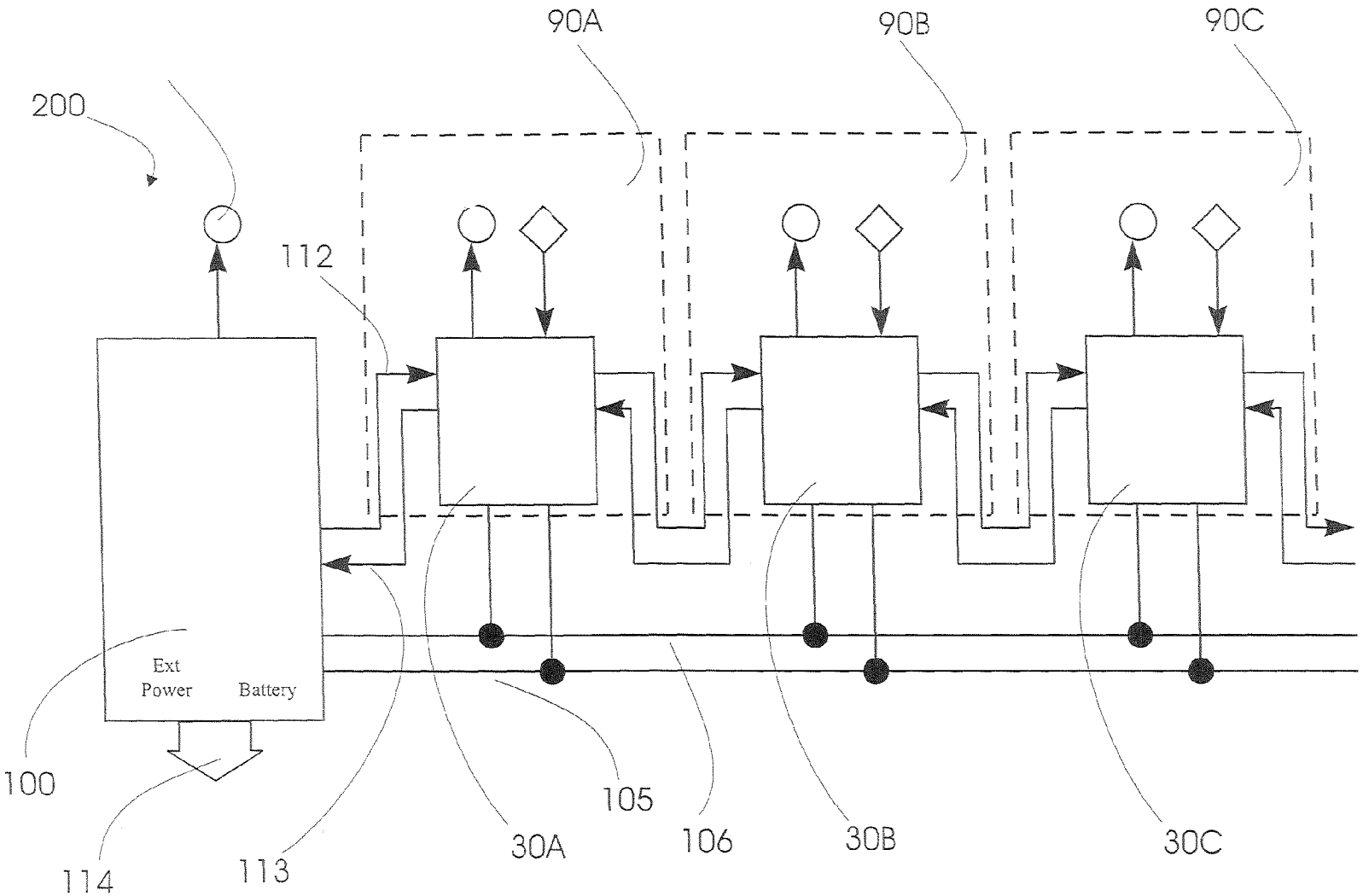
FIG. 11 is a plan view of a leak detection system according to a second example embodiment of the present invention.

Example embodiments of the full system configuration 200 are best seen in FIG. 11. In operation, the master controller 100, which is typically a microprocessor using a polling scheme, polls the leak detector system 90, shown as 90A, 90B, and 90C (each having a circuit board 30A, 30B, 30C). Although only three leak detector systems are shown in FIG. 11, the number of systems used in a particular application can vary from one to as many systems that are needed. The master controller 100 is connected to the leak detector systems 90 by several wires consisting of the transmitter signal wire 112, the receiving signal wire 113, the power voltage wire 106, and the system ground wire 105. While this configuration details a four-wire system, more or less wires can be used to achieve the same result. In preferred embodiments, all leak detector systems 90 are powered by the master controller 100, wherein the master controller is powered by a standard international AC transformer system. The master controller 100 can also contain a battery back up to provide service when the power is out.

As previously mentioned, the full system configuration 200 operation uses a continuous polling technique to verify that the leak detector systems 90 are responding and therefore operational. Additionally, the full system configuration 200 interrogates the status of each leak detector system 90 in turn. When water is sensed at any of the leak detector systems 90 within the full system configuration, the master controller 100 will receive the status and can alert the user via the master controller interface 114. The master controller interface 114 can be a multitude of interfaces depending upon the application, but in preferred example embodiments, the interface can be a contact closure, an alarm sounder, an LED indicator, an appropriate interface to a computer, an auto dialer interface, or any other means of interface to standard devices as required.

Figure 12:
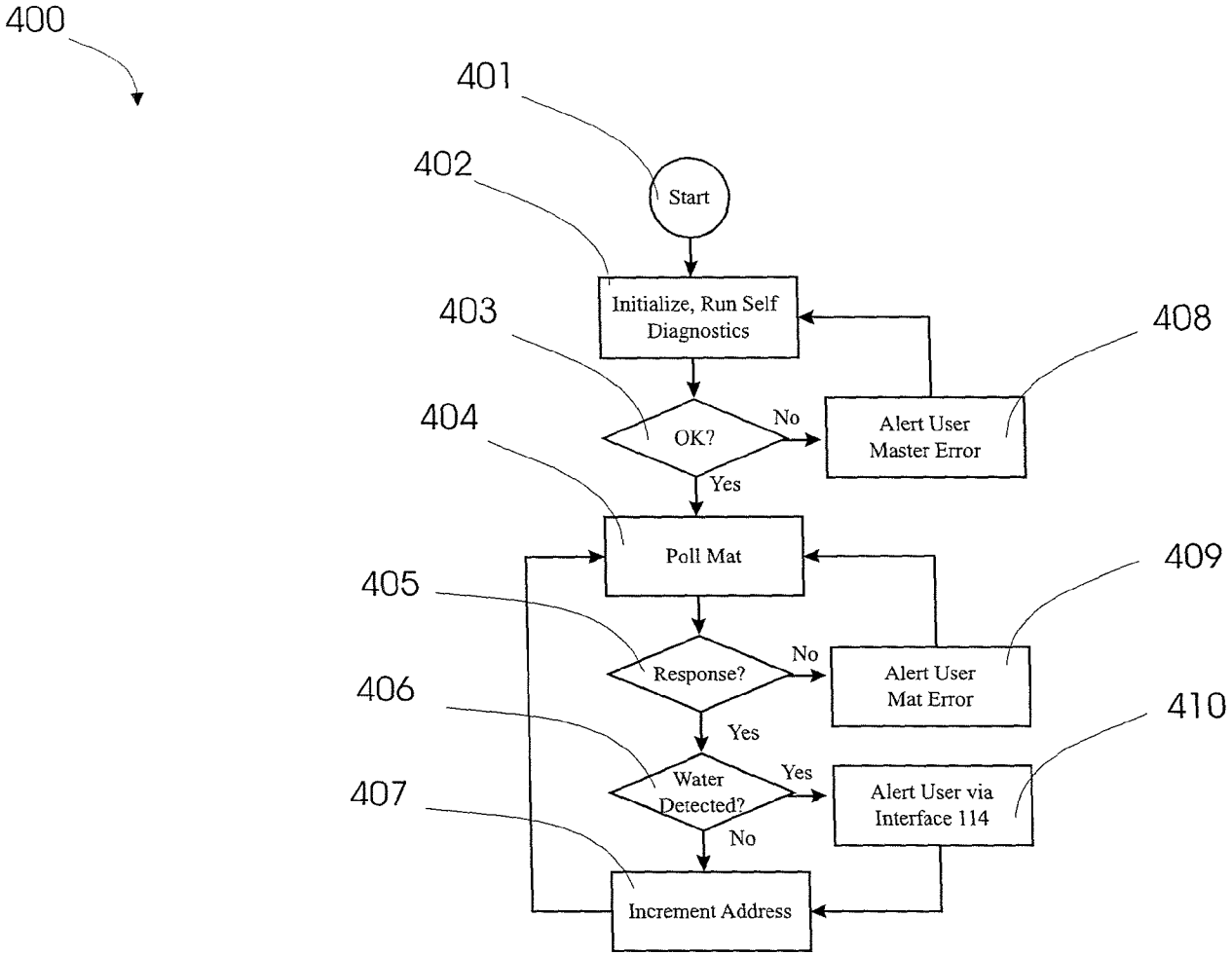
FIG. 12 is a software process diagram for the leak detection system shown in FIG. 11.

FIG. 12 shows an example software overview flow chart for the master controller software 400. Step 401 is the entry point into the software code stored within non-volatile memory in the master controller 100 (FIG. 11). Step 402 is the start up code that initializes all internal registers, input registers, and output registers, conducts a self-diagnostic test, and jumps to the application program. Step 403 is a decision block that decides if the master controller 100 is functioning properly. If it is not, the program jumps to step 408 to issue an alert to the user that something is not working properly and then moves to step 402 to continue checking for errors. If it is functioning properly, the program jumps to step 404. Step 404 is the polling code that polls all of the leak detector systems 90 attached to the master controller 100. It is a serial protocol that contains a sequential address for all leak detector systems 90 to read, and then the master controller 100 waits for a reply from the addressed leak detector system. The address is sequenced until all attached leak detector systems 90 have been polled. Step 405 checks to see if the leak detector system 90 responded. If it did not, the program jumps to step 409 which alerts the user that a leak detector system 90 is not responding and then moves to step 404 to continue polling. If it did receive a response, the program jumps to step 406. Step 406 parses the information flags sent from the leak detector system 90 to check to see if water is present in the leak detector system's 90 individual units 1. If water is detected, the program jumps to step 410, which issues a master alert as previously described above and jumps to step 407 to increment the address and then jumps to step 404 to continue polling. If water is not detected in step 406, the program jumps to step 407 and increments the address to be sent to the leak detector systems 90 until all systems have been interrogated. The program then loops back to step 404 and continuously loops through the steps as described above.

Figure 13:
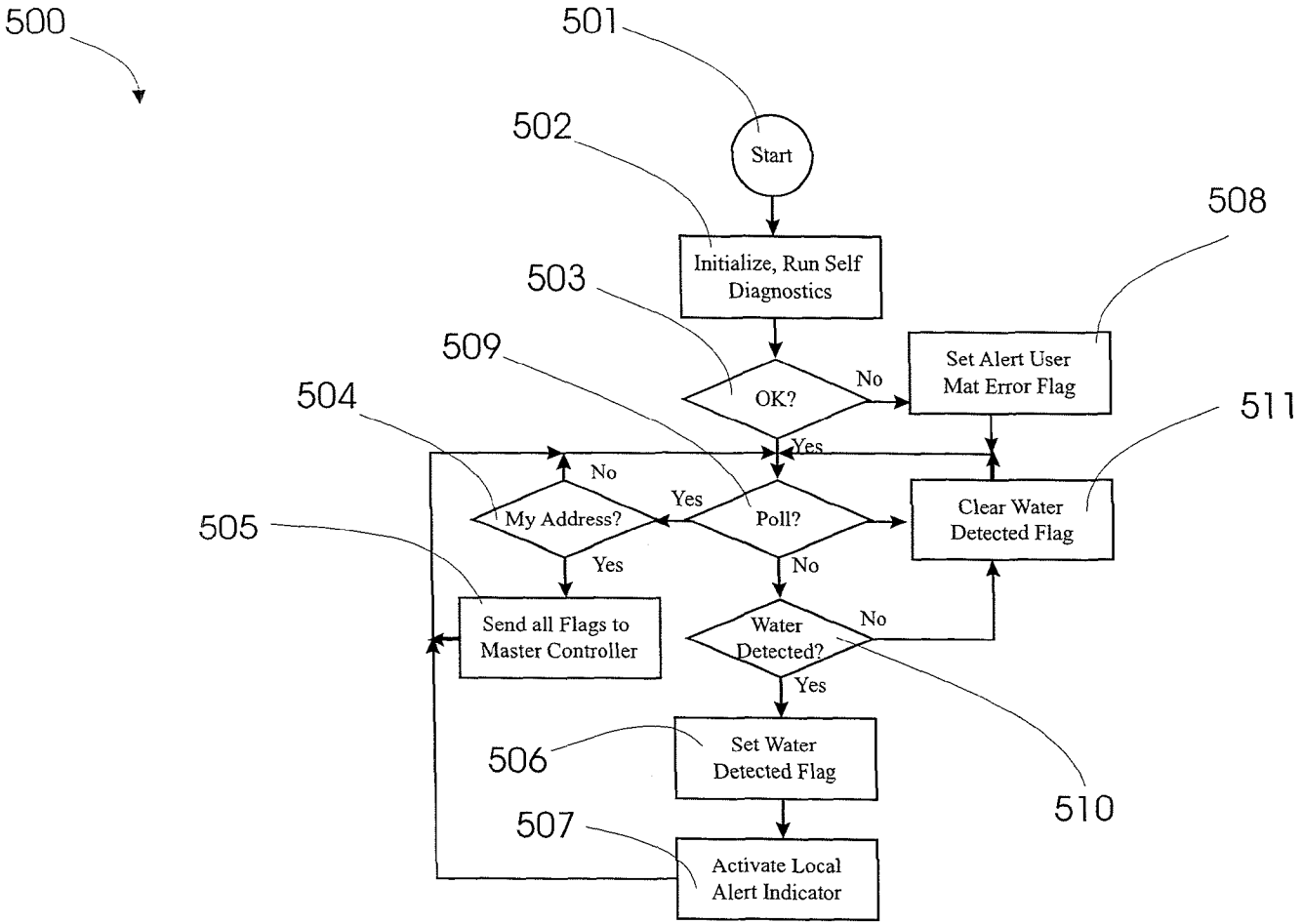
FIG. 13 is a software process diagram for the leak detection system shown in FIG. 11.

FIG. 13 shows another example software overview flow chart for the leak detector system 90 software 500. Step 501 is the entry point into the software code stored within non-volatile memory in the microprocessor 32 (shown in FIG. 10). Step 502 is the start up code that initializes all internal registers, input registers, and output registers, conducts a self diagnostic test, and jumps to the application program. Step 503 is a decision block that decides if the microprocessor 32 and associated circuitry is functioning properly. If it is not, the program jumps to step 508 to set an error flag to alert the master controller 100 that something is not working properly and then moves to step 509 to continue. If it is functioning properly, the program jumps to step 509. Step 509 is a decision block that checks to see if the master controller 100 is polling the leak detector system 90. If polling is not occurring, the program jumps to step 510 to check for the presence of water. If polling is occurring, the program jumps to step 504 to check for an address match from the master controller 100. If the address does not match the slave address, the program ignores the polling information and loops back to step 509 to continue monitoring. If the address matches in step 504, then the addressed leak detector system 90 sends all flags to the master controller 100, in step 505, and then loops back to step 509 to continue monitoring. In step 510, if water is not detected, the program jumps to step 511, which resets the water detected flag and then loops back to step 509 to continue monitoring. If water is detected in step 510, the program jumps to step 506 to set the water detected flag. Subsequently the program then jumps to step 507 to activate the local alert indicator and then loops back to step 509 to continue monitoring.

Figure 14:
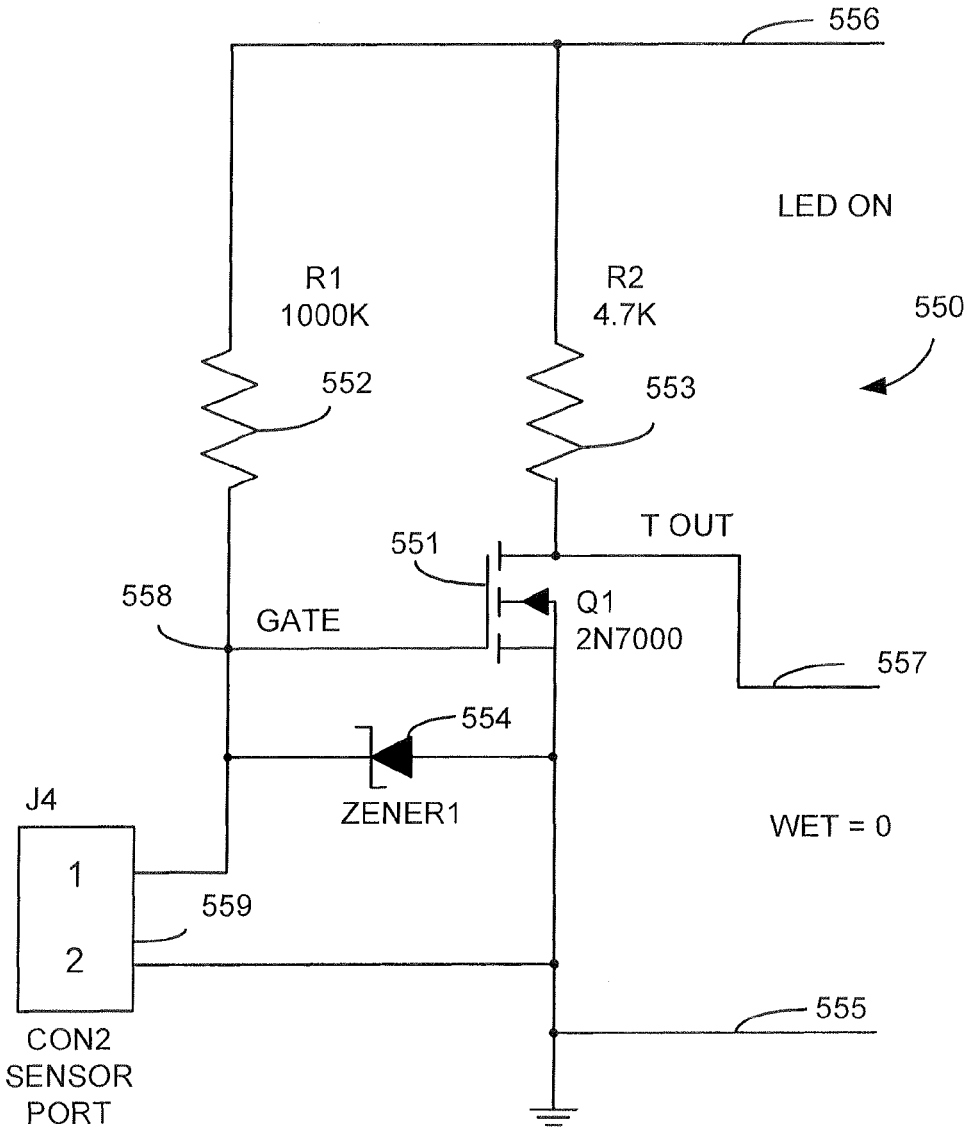
FIG. 14 is a plan view of a wiring diagram for a portion of the leak detector apparatus shown in FIG. 11.

FIG. 14 is a plan view of a wiring diagram for a portion of the leak detector apparatus shown in FIG. 11. The circuit 550 shown in this figure is designed to minimize supply current and to provide reliable sensing of the water when present. The wires 555 and 556 are connected to the input via jack J4 559 as shown above. Zener1 554 is a zener diode that serves as a static discharge arrestor across the sensor to prevent damage to the high impedance circuitry. FET transistor Q1 551 provides the switching function required to sense the presence of the water. It has a very high input impedance using resistors 552 and 553 and the ability to sense micro currents on its gate 558, resulting is in a digital switching function at the T out node 557.

Figure 15:
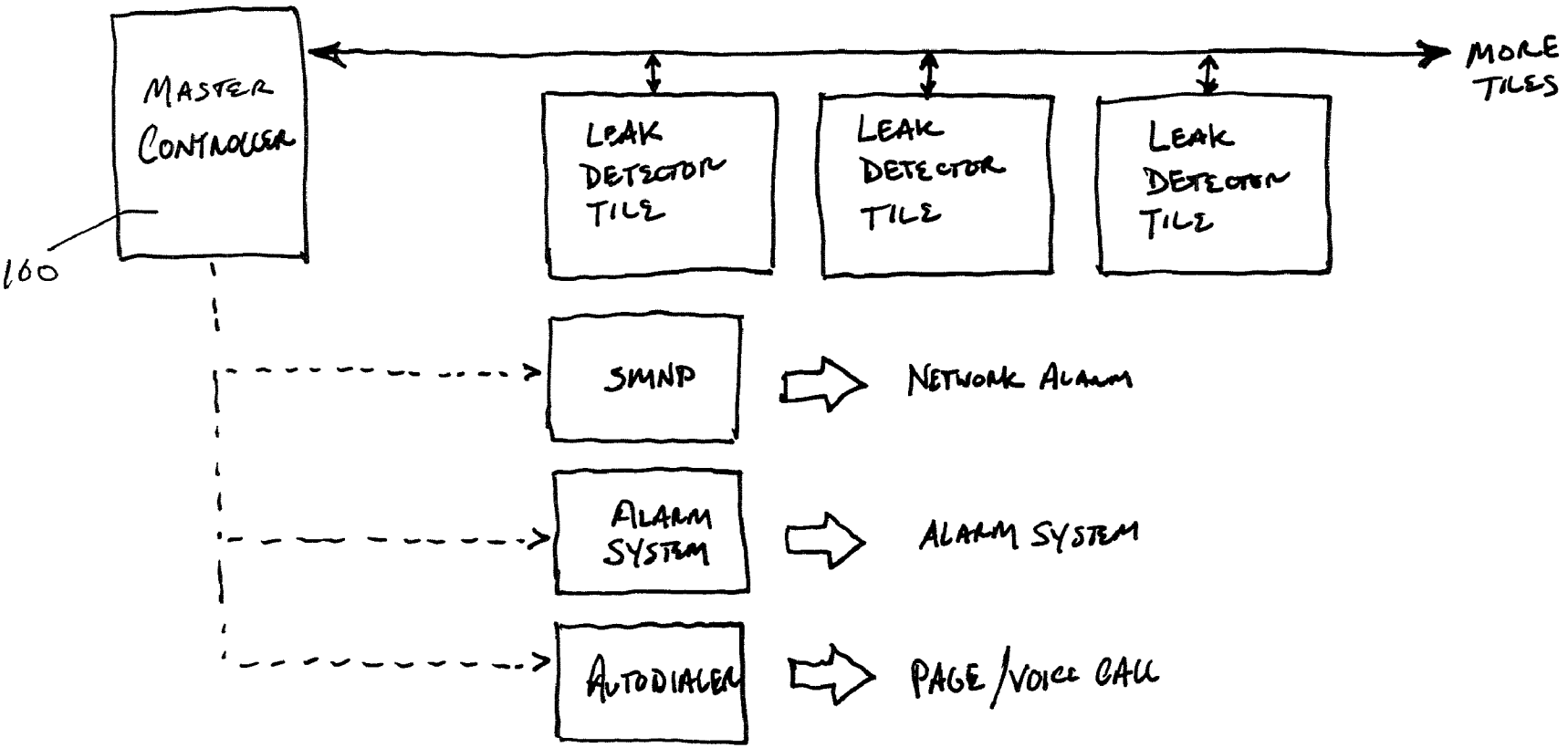
FIG. 15 is a functional diagram for the leak detection system shown in FIG. 11.

FIG. 15 is a functional diagram for the leak detector system shown in FIG. 11. As shown herein, the master controller 100 can receive an indication from any of one or more of the leak detector tiles and can then take action in response thereto. These actions can include using an auto dialer to initiate a page call or a voice call, using the alarm system to communicate with an external alarm system, and/or using simple network management protocol (SNMP) to sound a network alarm.

Figure 16:
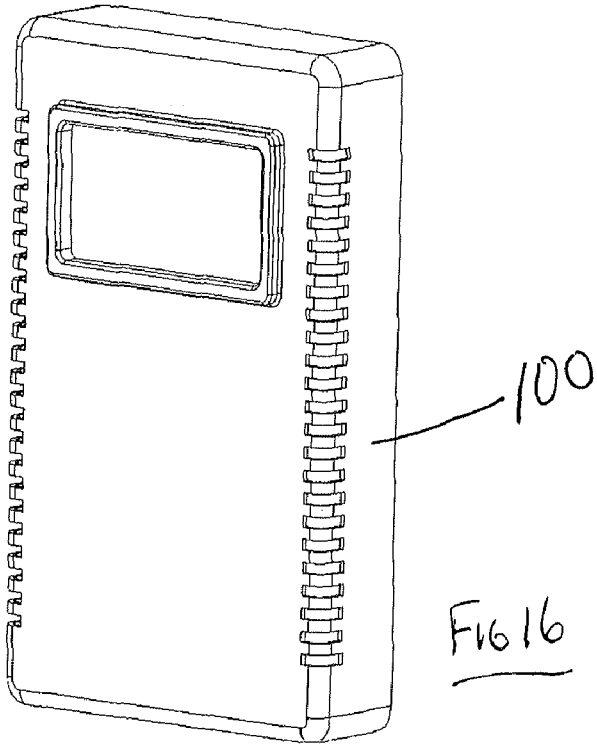
FIG. 16 is a perspective view of a master controller portion of the leak detection system shown in FIG. 11.
Figure 17:
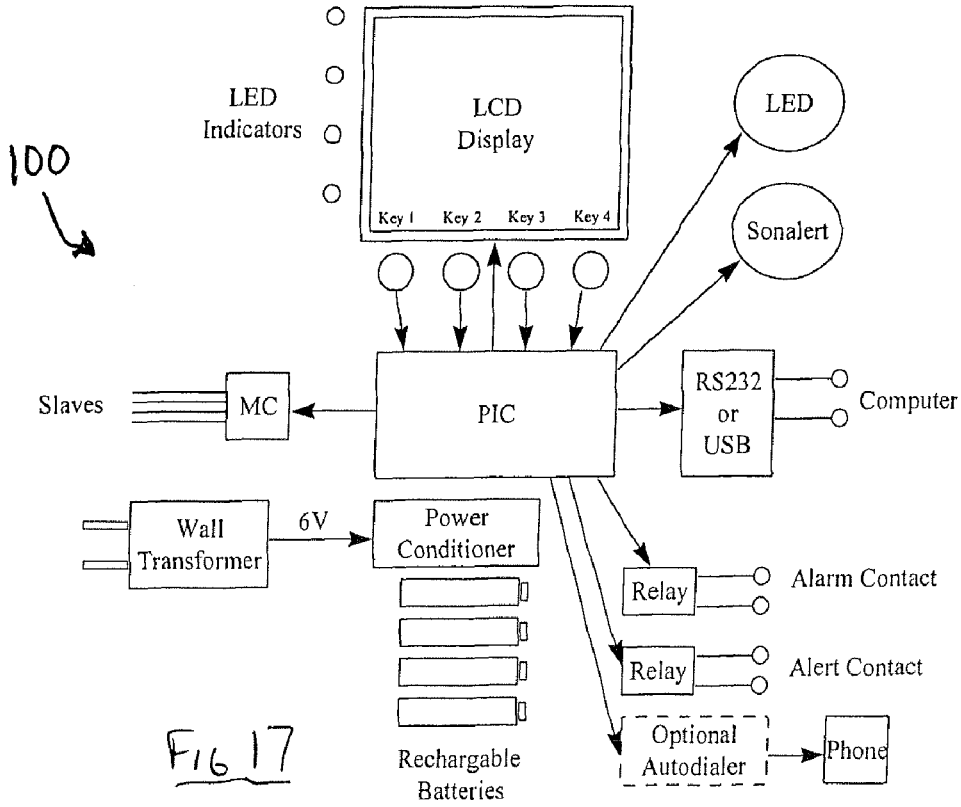
FIG. 17 is a functional diagram of the construction and operation of the master controller of FIG. 16.

FIG. 16 is a perspective view of a master controller 100 of the leak detection system shown in FIG. 11. Of course, it will be understood that the master controller depicted in this figure is for illustration purposes only and that the master controller can take various forms or shapes. FIG. 17 is a functional diagram of the construction and operation of the master controller of FIG. 16. Some features and functionality that one skilled in the art might wish to provide in the master controller 100 include the following:

1. An LCD display to show all system information and status. It will be a monochrome backlit graphic display that will display text and graphics as need to make the controller user friendly and unambiguous.
2. Power on/off switch—preferably, an embedded slide switch that will not be easily bumped
3. An LED display showing AC power is present
4. A Battery Warning Light that flashes if the battery is becoming discharged
5. A Sonalert audio warning device to provide audio feedback of issues
6. Control Switches that control the action of the master controller
   a. Lights on when polling
   b. Light off when polling
   c. Remote alerts off
   d. Remote alerts on
   e. Diagnostic poll of all tiles
7. Power input jacks
8. Optional USB interface—this could ultimately allow a computer to operate and manage all of the functions of the master controller.
9. Optional Auto-dialer to dial phone numbers and present a prerecorded audio message when the alarm is present.

Figure 18A:
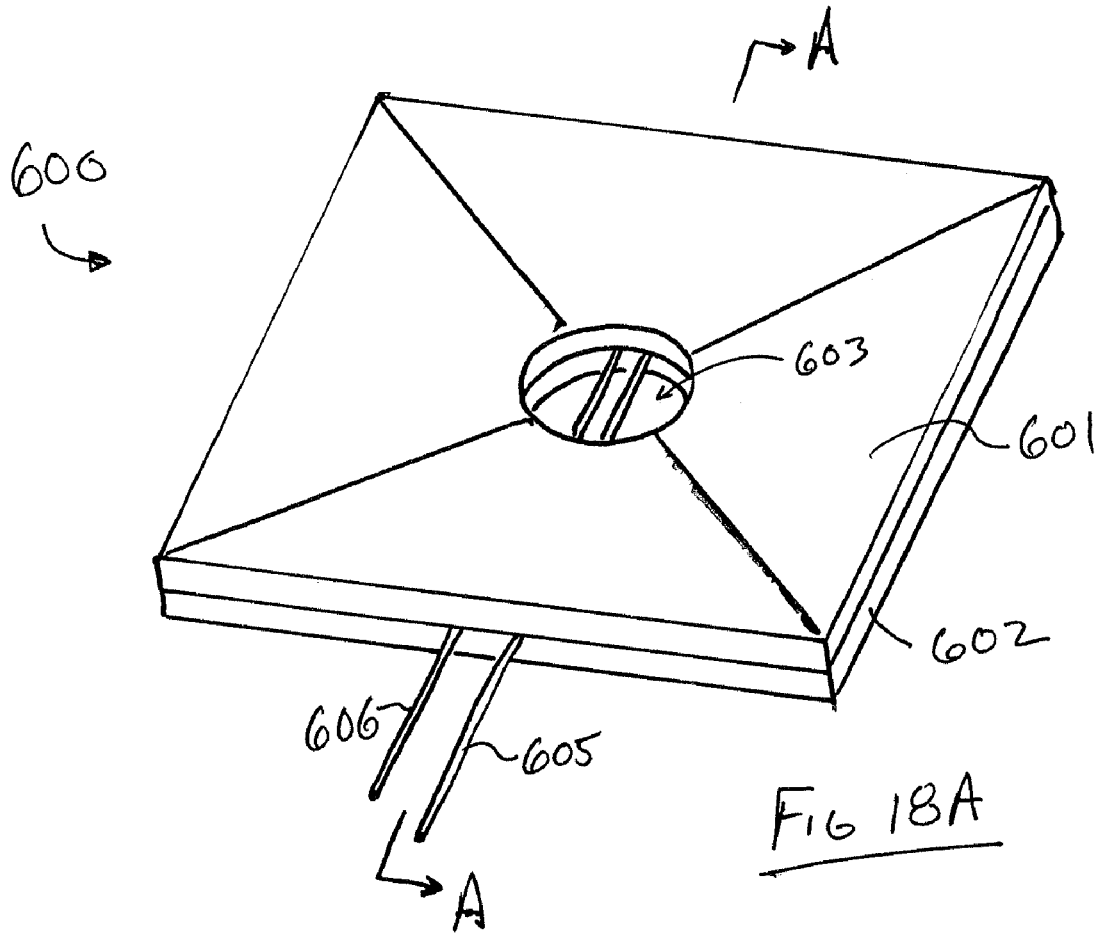
FIG. 18A is a perspective view of a leak detector unit having a plurality of layers according to another example embodiment of the present invention.

FIG. 18A is a perspective view of a leak detector unit having a plurality of layers according to another example embodiment of the present invention. In this embodiment, the leak detection cell, which is contemplated to be just one of many that is used in a leak detector tile, is made from these two layers of closed cell foam, rather than three layers of closed cell foam as depicted in FIG. 1. Indeed, the leak detector tile is contemplated according to this embodiment to be made up of two layers of closed cell foam. The leak detector unit 600 includes an upper layer 601 and a lower layer 602. In this embodiment, the wires 605 and 606 lie the same horizontal plane and are not separated by a layer foam positioned therebetween. This construction has the advantage over that shown in the first embodiment of being simpler to construct and cheaper. Like in the first embodiment, the leak detector unit 600 has a funnel shape formed in the top of upper layers 601 to help funnel water into the collector cup for sensing by the wires 605 and 606. While FIG. 18A depicts a pyramidal funnel shape, those skilled in the art will recognize that any funnel shape can be provided, such as a flat cone.

Figure 18B:
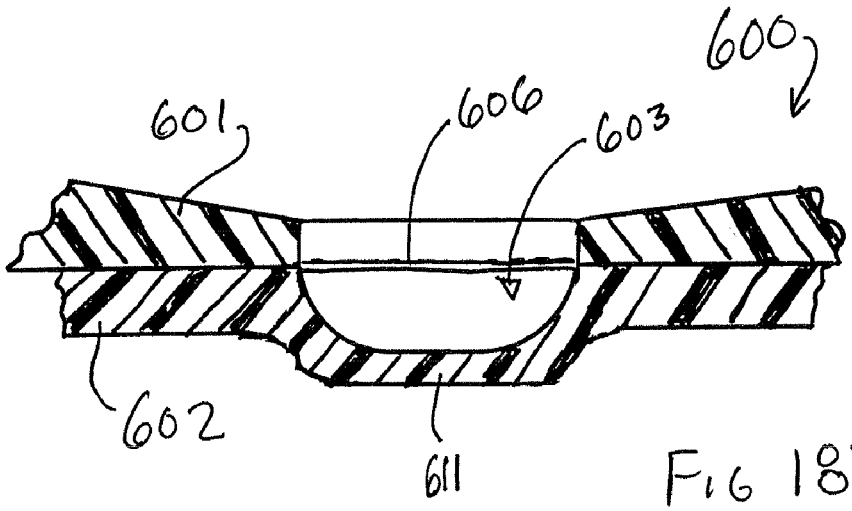
FIG. 18B is a sectional view of a leak detector unit according to FIG. 18A, taken along lines A-A.

FIG. 18B is a sectional view of a leak detector unit according to FIG. 18A, taken along lines A-A. As best seen in this figure, the water collection cup 603 is formed by creating an opening in the upper layer 601 and a depression in the lower layer 602. This depression in the lower layer 602 creates a foot 611 that tends to deepen the water collector cup 603 and also acts to stand the leak detector unit above the upper surface of a ceiling tile upon which it rests. This tends to minimize the growth of algae, fungus, mildew, etc. underneath the leak detector tile.

Figure 19:
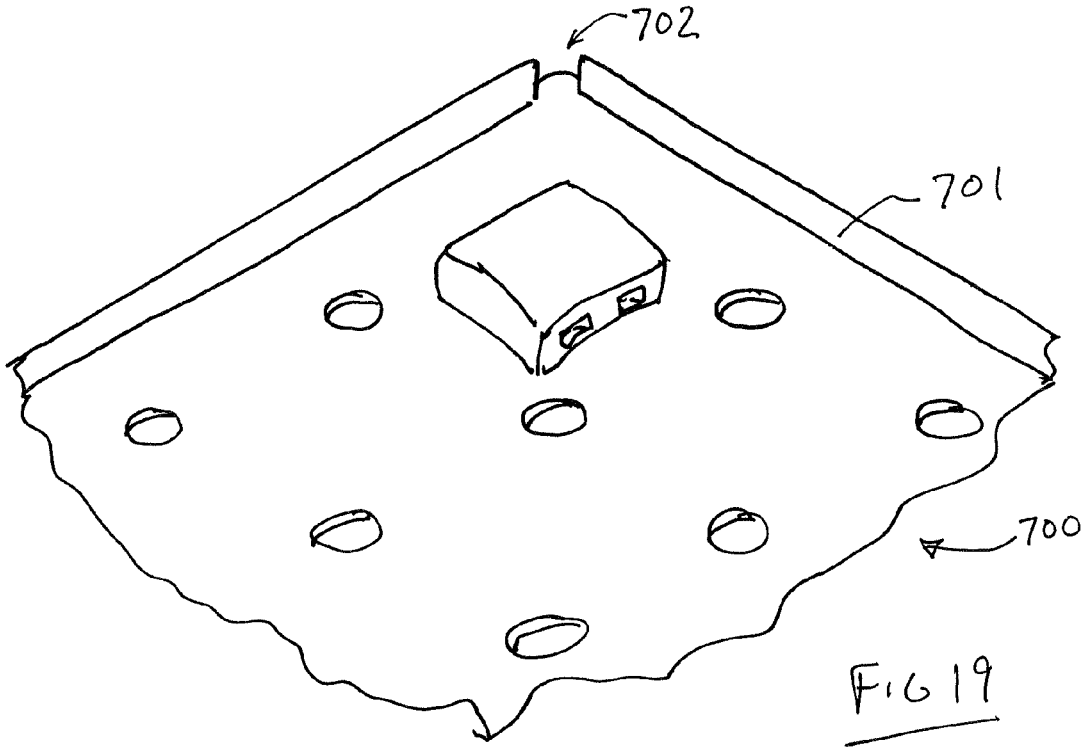
FIG. 19 is a perspective view of a leak detector unit according to another example embodiment of the present invention and shown including an interrupted peripheral rim.

FIG. 19 is a perspective view of a leak detector unit 700 according to another example embodiment of the present invention and shown including an interrupted peripheral rim 701. With this construction, water cannot build up to dangerous levels leading to a catastrophic failure of the ceiling. Instead, if the leak continues unabated, as water collects in the collector cups and then floods the top of the collector tile 700, water can escape in the corners thereof, such as corner 702. The peripheral rim 701 is interrupted in the four corners, providing the water with an escape. In this way, excessive water weight is prevented from being borne by the ceiling tile.

Figure 20:
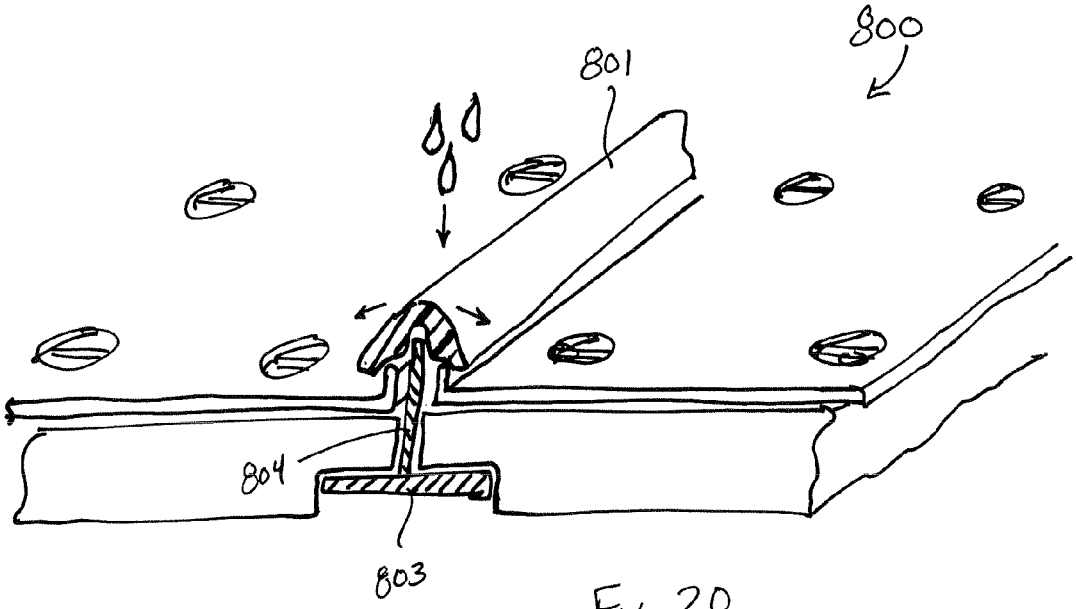
FIG. 20 is a perspective view of a leak detector unit according to another example embodiment of the present invention and shown including a roof deflector for deflecting falling liquid away from the support grid that supports a drop ceiling.

FIG. 20 is a perspective view of a leak detector unit 800 according to another example embodiment of the present invention and shown including a roof deflector 801 for deflecting falling liquid away from the support grid that supports a drop ceiling. The roof deflector 801 preferably is made from closed cell foam and is easily trimmed to length to cover the grid of support beams (such as support beam 803) holding up the ceiling tiles and the leak detection tiles. The roof deflector preferably is extruded to include a central slot on the underside thereof to allow it to be snugly fitted to the upstanding web 804 of the support beam. This tends to secure it in place and makes installation easy.

Figure 21A:
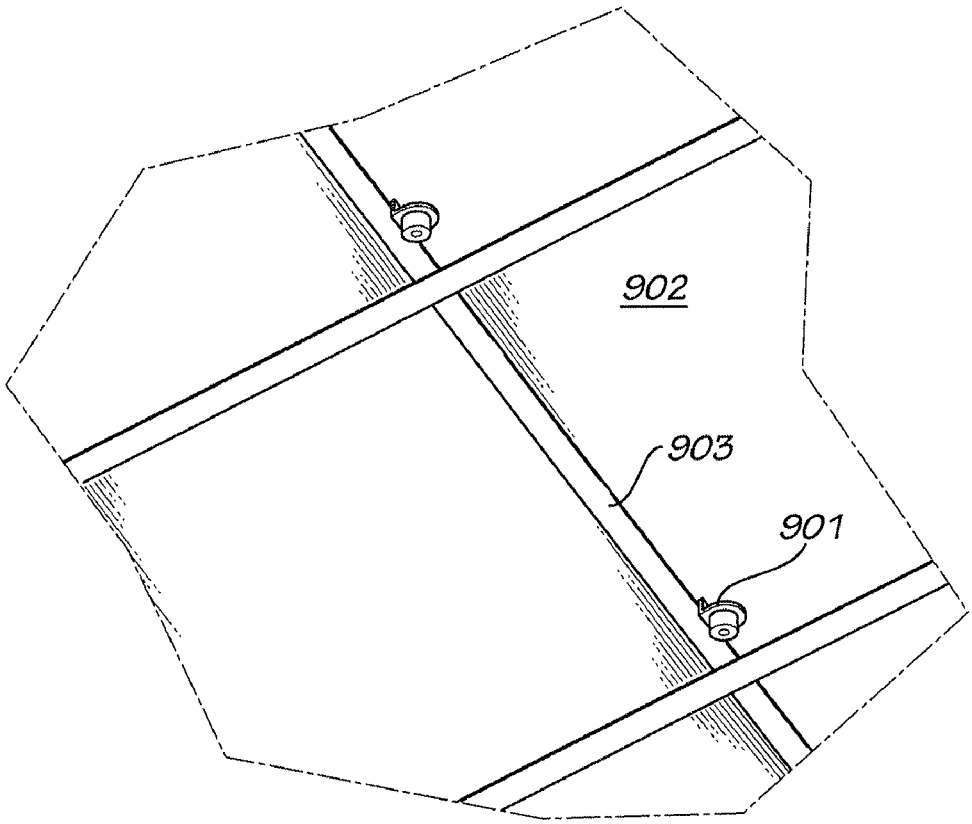
FIG. 21A is a perspective view of a leak detector unit according to another example embodiment of the present invention and shown from the underside of a drop ceiling and including an alarm indicator lamp for visually indicating which ceiling tile in a drop ceiling has or is suffering a leak.

FIG. 21A is a perspective view of a leak detector unit according to another example embodiment of the present invention and shown from the underside of a drop ceiling 902 and including an alarm indicator lamp 901 for visually indicating which ceiling tile in a drop ceiling has or is suffering a leak.

Figure 21B:
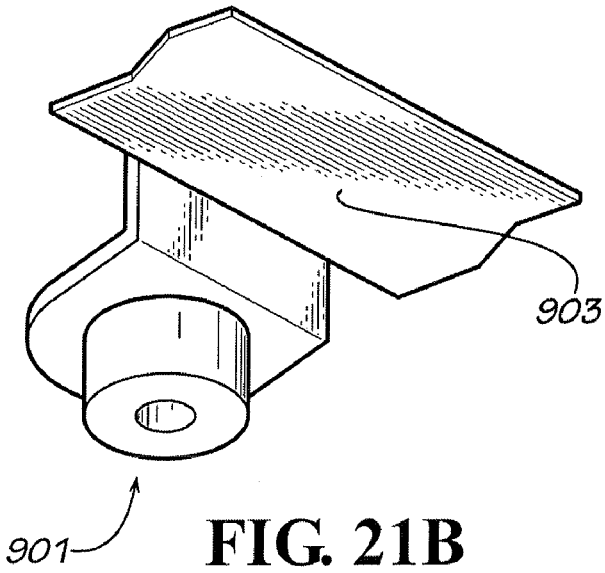
FIG. 21B is a perspective, detailed view of an alarm indicator lamp portion of the leak detector unit of FIG. 21B.

FIG. 21B is a perspective, detailed view of the alarm indicator lamp 901 of the leak detector unit of FIG. 21A. As can be seen in this and the preceding figure, the alarm indicator lamp 901 wraps around the edge of the ceiling tile along the edge of the support beam 903 holding up the ceiling tile.

Advantageously, the inventions described herein can be scaled up easily to produce larger sensor systems (it is scalable). The leak detector of the present inventions can be manufactured in many sizes, shapes, and materials. Moreover, the design of the present inventions allows the sensitivity to be adjusted (the amount of water required to sense) in the manufacturing process. It is also simple, reliable, and can be installed easily by an end user. By using foam to form the leak detection tiles, they are flexible and can be folded or bent to conform to smaller areas. It also can be trimmed or folded to fit smaller areas without altering its functionality.

Advantageously, the design of the present invention allows for a low false alarm rate and is not unduly sensitive to minute quantities of water that pose no significant threat or danger.

Notably, devices according to the present invention can detect the presence of water and alert the end user, and can also indicate more specifically where the water was detected by sending the location to the master controller and/or using an alert means local to each sensing entity.

The invention can be manufactured in large coverage configurations that are easily installed by the end user. Moreover, the invention provides a low cost per square foot solution and is made from readily available materials. It does not absorb water and is reusable when the water is no longer present. Further, the size, width, length and shape of the leak detector tile can be varied without negatively impacting its effectiveness as a liquid sensor.

While the invention has been described with reference to preferred and example embodiments, it will be understood by those skilled in the art that a variety of modifications, additions and deletions are within the scope of the invention, as defined by the following claims.

What is claimed is:

1. A leak detector apparatus for use with a drop ceiling having a grid-work of ceiling tiles, the leak detector apparatus comprising:

a non-conducting tile body shaped and dimensioned to rest atop a ceiling tile, the tile body comprising multiple non-conducting non-absorbing layers and having a plurality of water collector cups therein, and wherein each of the plurality of water collector cups is formed by creating an opening in at least one of the multiple layers by removing a portion of the multiple non-conducting non-absorbing layers;

a pair of spaced apart sensor wires forming an electrical grid, a portion of the sensor wires being separated by one of the non-conducting non-absorbing multiple layers of the tile body, one sensor wire extending on only one side of the one non-conducting non-absorbing layer and the other sensor wire extending on only the opposite side of the one non-conducting non-absorbing layer, the sensor wires extending through the water collector cups, and the sensor wires being operative to sense the presence of water in the water collector cups; and an electronics module associated with the sensor wires and electrically coupled thereto for triggering an alert in response to the presence of water in one or more of the water collector cups.

2. A leak detector apparatus as claimed in claim 1 wherein the tile body includes shallow funnels for collecting water and funneling it into the water collector cups.

3. A leak detector apparatus as claimed in claim 1 wherein the tile body is flexible to allow it to be conformed to various shapes.

4. A leak detector apparatus as claimed in claim 1 wherein the spaced-apart sensor wires are spaced apart horizontally.

5. A leak detector apparatus as claimed in claim 1 wherein the spaced-apart sensor wires are spaced apart vertically.

6. A leak detector apparatus as claimed in claim 5 wherein the multiple layers of the non-conducting tile body comprise at least three layers, with at least one layer positioned between the spaced-apart sensor wires.

7. A leak detector apparatus as claimed in claim 1 wherein the sensor wires are un-insulated prior to installation between the multiple layers of the tile body.

8. A leak detector apparatus as claimed in claim 1 wherein the tile body has dimples formed in the lowermost layer thereof to deepen the water collector cups.

9. A leak detector apparatus as claimed in claim 1 wherein the tile body has feet formed in the lowermost layer thereof to support most of the tile body above the ceiling tile to minimize the growth of mold, algae, mildew, and fungus.

10. A leak detector apparatus is claimed in claim 1 wherein the electrical grid of sensor wires extends between distal edges of the non-conducting tile body in a manner to traverse most of the tile body.

11. A leak detector apparatus as claimed in claim 1 wherein the electrical grid of sensor wires is formed in such a way to allow the leak detector apparatus to be trimmed along at least one edge while maintaining the integrity of the electrical grid.

12. A leak detector apparatus as claimed in claim 1 wherein the electronics are operable to trigger an audible or visible alarm to indicate the presence of water in the water collector cups.

13. A leak detection system for use with a drop ceiling having a plurality of ceiling tiles and a grid frame supporting the ceiling tiles, the leak detection system comprising:

a plurality of lightweight non-conductive leak detection tiles adapted to be placed atop the ceiling tiles of the drop ceiling, each non-conductive leak detection tile including multiple non-conducting non-absorbing layers and one or more sensors for detecting the presence of liquid at one or more locations on the ceiling tile, wherein each one of the one or more sensors is located in a water collector cup formed in each of the non-conductive leak detection tiles by creating an opening in at least one of the multiple layers by removing a portion of the multiple non-conducting non-absorbing layers;

a pair of spaced apart sensor wires forming an electrical grid, a portion of the sensor wires being separated by one of the non-conducting non-absorbing multiple layers of the tile body, one sensor wire extending on only one side of the one non-conducting non-absorbing layer and the other sensor wire extending on only the opposite side of the one non-conducting non-absorbing layer, the sensor wires extending through the water collector cups, and the sensor wires being operative to sense the presence of water in the water collector cups; and a plurality of local processors electrically coupled to the plurality of sensors, the local processors being provided at least one per leak detection tile; and a master controller in communication with the local processors for monitoring the function and operation of each local processor.

14. A leak detection system as claimed in claim 13 wherein the local processors are linked to one another in a daisy-chain arrangement.

15. A leak detection system as claimed in claim 13 wherein the master controller is operative to determine which, if any, of the non-conductive leak detection tiles has detected a leak.

16. A leak detection system as claimed in claim 13 further comprising deflector roofs adapted to be positioned atop the grid frame for deflecting liquid that might otherwise impinge on the grid frame and for deflecting the liquid onto an adjacent non-conductive leak detection tile.

17. A leak detection system as claimed in claim 16 wherein the deflector roofs comprise foam.

18. A leak detection system as claimed in claim 17 wherein the non-conductive leak detector tiles comprise non-conducting foam.

19. A leak detection system as claimed in claim 13 wherein the sensors comprise parallel, spaced-apart wires.

20. A leak detection system as claimed in claim 19 wherein the length and/or width of the non-conductive leak detection tiles can be trimmed without destroying the function of the remaining leak detection sensors in the leak detection tile.

21. A leak detection system as claimed in claim 19 wherein the parallel spaced-apart wires are spaced apart horizontally from one another.

22. A leak detection system as claimed in claim 19 wherein the parallel spaced-apart wires are spaced apart vertically.

23. A leak detection system as claimed in claim 13 wherein the non-conductive leak detection tiles comprise feet for supporting the non-conductive leak detection tiles slightly above the ceiling tile to minimize the growth of molds, algae, mildew, or fungus.

24. A leak detection system as claimed in claim 13 wherein the leak detection tiles comprise flexible foam to allow the non-conductive leak detection tiles to be fitted in irregular spaces.

* * * * *